US006733155B2

(12) United States Patent
Lee et al.

(10) Patent No.: US 6,733,155 B2
(45) Date of Patent: May 11, 2004

(54) DECORATIVE LIGHT BULB

(75) Inventors: Steve Lee, Chicago, IL (US); Shui Yu Lee, Prospect Heights, IL (US)

(73) Assignee: LumiSource, Inc., Elk Grove Village, IL (US)

( * ) Notice: Subject to any disclaimer, the term of this patent is extended or adjusted under 35 U.S.C. 154(b) by 0 days.

(21) Appl. No.: 10/006,250

(22) Filed: Dec. 4, 2001

(65) Prior Publication Data

US 2003/0103350 A1 Jun. 5, 2003

(51) Int. Cl.[7] ..... H01R 33/00

(52) U.S. Cl. ..... 362/226; 362/216; 362/351; 362/256; 362/363

(58) Field of Search ..... 362/226, 216, 362/351, 256, 363, 255, 263, 249, 806, 809; 439/217, 218, 22, 221, 537; 313/493, 634, 635, 318.01, 318.12, 467

(56) References Cited

U.S. PATENT DOCUMENTS

| | | | | | |
|---|---|---|---|---|---|
| 4,598,229 | A | * | 7/1986 | Henning et al. | 313/493 |
| 5,030,100 | A | * | 7/1991 | Hilderman | 434/132 |
| 6,247,829 | B1 | * | 6/2001 | Lee | 362/226 |
| 6,554,453 | B2 | * | 4/2003 | Rao | 362/277 |

* cited by examiner

*Primary Examiner*—Sandra O'Shea
*Assistant Examiner*—Mark Tsidulko
(74) *Attorney, Agent, or Firm*—Pauley Petersen & Erickson

(57) ABSTRACT

A decorative light bulb includes an outer surface forming a decorative shape and one or more inert gases inserted within the decorative light bulb to create ethereal electrical arcing having a first color. A surface feature is formed along the outer surface and a coating is applied on an inner surface of the surface feature. As a result of the coating, ethereal electrical arcing is formed having a second color along the inner surface of the surface feature.

11 Claims, 4 Drawing Sheets

DECORATIVE LIGHT BULB

BACKGROUND OF THE INVENTION

1. Field of the Invention

This invention relates to a decorative light bulb having a contoured surface feature with a coating applied to an inner surface of the contoured surface feature to produce a localized multi-color display.

2. Description of Related Art

Decorative light bulbs include those wherein a voltage is applied across one or more inert gases within the bulb to create a plurality of traveling, ethereal electrical arcs. This arcing effect traces across the outer surface of the bulb and follows arbitrary patterns throughout the bulb. Existing decorative light bulbs generally only include a single color or multiple colors that arc in arbitrary patterns.

SUMMARY OF THE INVENTION

It is one object of this invention to provide a decorative light bulb having a electrical arcing display of two or more colors positioned to form distinct surface features that define a decorative shape.

It is another object of this invention to provide a decorative light bulb having a coating along an inner surface of surface features to provide a second distinct color of electrical arcing or illumination during operation of the decorative light bulb.

It is still another object of this invention to provide a decorative light bulb formed in a decorative shape with surface features illuminated with a distinct color from the remaining outer surface of the decorative light bulb.

According to a preferred embodiment of this invention, a decorative light bulb is an electrical ornamental or decorative bulb wherein a voltage is applied across one or more inert gases within the bulb to create a plurality of traveling, ethereal electrical arcs in one or more colors.

The decorative light bulb preferably includes an outer surface forming a decorative shape having pleasing, recognizable and/or desirable aesthetics such as a globe, a cube, an animal such as a dolphin, a skull, a plant such as a mushroom, a tornado shape, a fanciful sculpture or any other feasible configuration.

According to a preferred embodiment of this invention, surface features are formed on the outer surface. Surface features preferably distinguish and define the decorative shape. A coating is then applied along an inner surface of the surface feature. The coating is preferably a phosphor or a similar agent known to those having ordinary skill in the art. When the decorative light bulb is not in operation, the coating is preferably not visible along the outer surface of the decorative light bulb.

One or more inert gases are preferably inserted within the decorative light bulb so that when a charge is applied to the inert gases, an ethereal electrical arcing is created.

The localized application of the coating along the inner surface of the surface feature results in, during a powered state of the decorative light bulb, a first color illuminating the outer surface of the decorative light bulb and a second color along the inner surface of the surface feature thereby distinguishing the surface feature from the remainder of the outer surface. As a result, during operation of the decorative light bulb, electrical arcing having a first color will illuminate the outer surface and electrical arcing having a second color will illuminate the surface features.

BRIEF DESCRIPTION OF THE DRAWINGS

The drawings show a decorative light bulb, according to preferred embodiments of this invention, wherein.

DETAILED DESCRIPTION OF THE PREFERRED EMBODIMENTS

Figure 1:
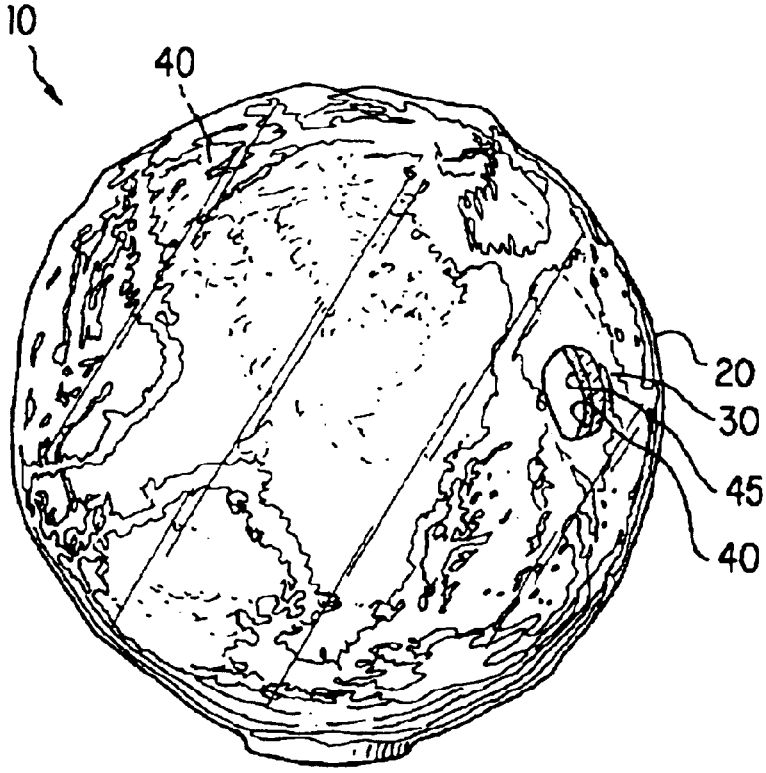
FIG. 1 is a side view of a decorative light bulb according to one preferred embodiment of this invention.
Figure 2:
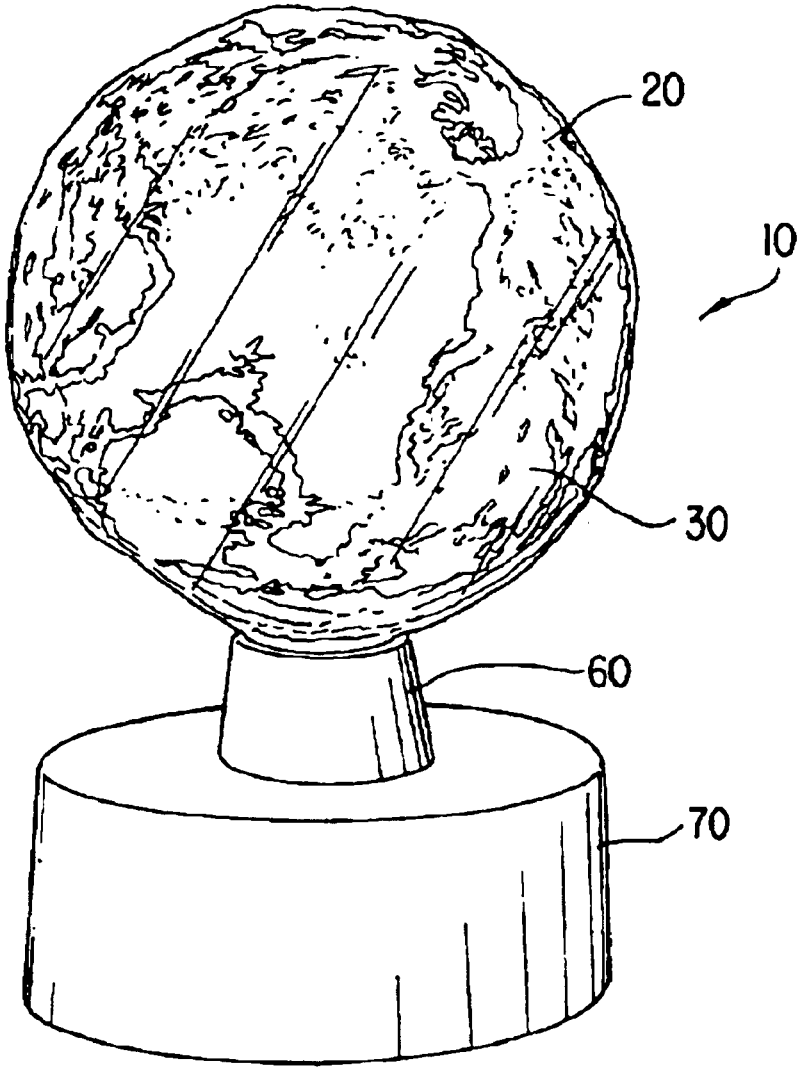
FIG. 2 is a side view of the decorative light bulb shown in FIG. 1 and positioned within a base.
Figure 3:
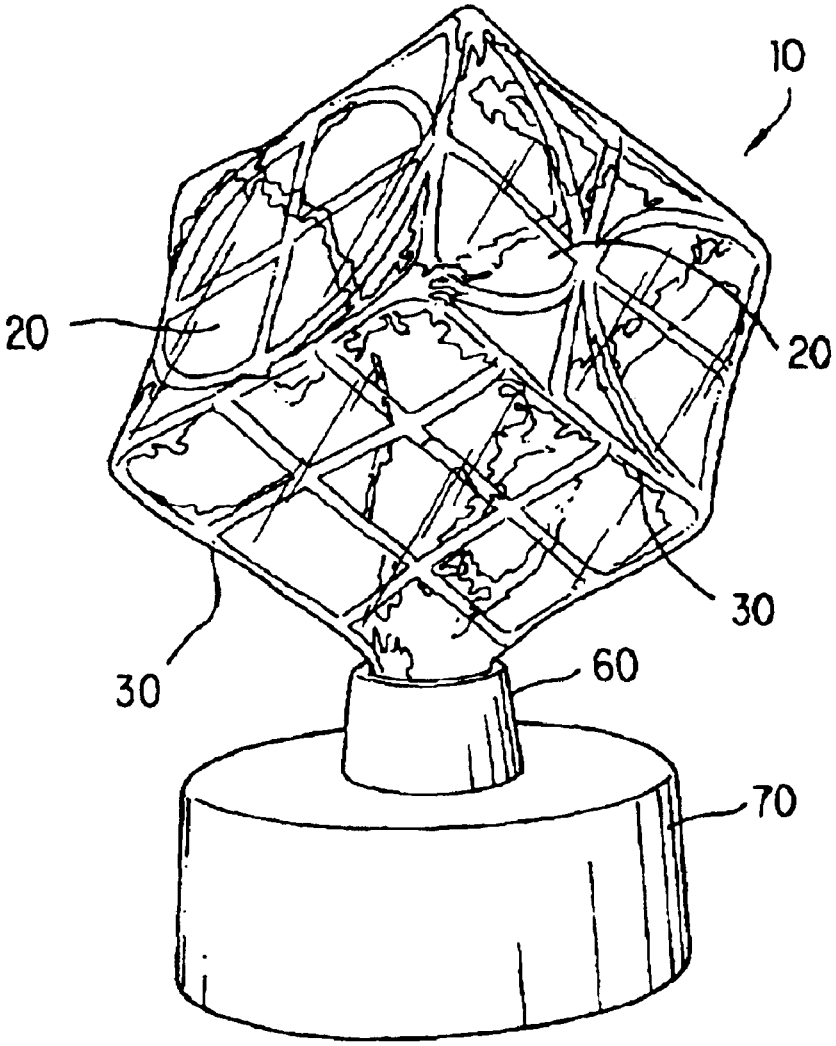
FIG. 3 is a side view of a decorative light bulb according to another preferred embodiment of this invention.
Figure 4:
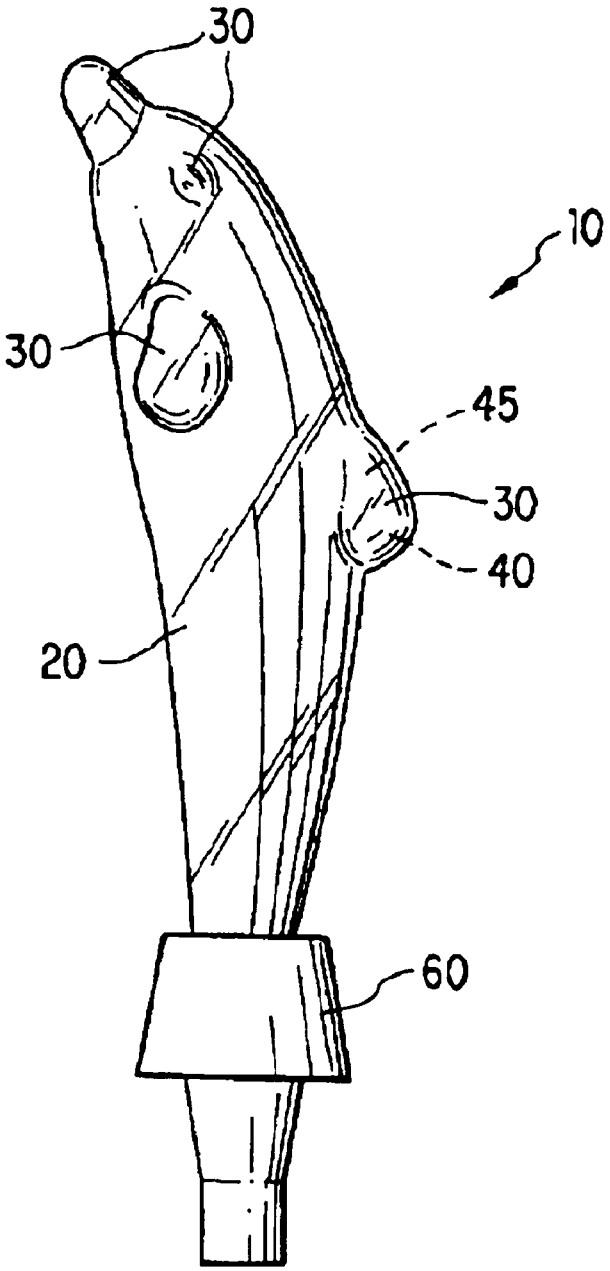
FIG. 4 is a side view of a decorative light bulb according to yet another preferred embodiment of this invention.

FIGS. 1–4 show various embodiments of decorative light bulb 10 according to preferred embodiments of this invention. Decorative light bulb 10 is preferably an electrical ornamental or decorative bulb wherein a voltage is applied across one or more inert gases within the bulb to create a plurality of traveling, ethereal electrical arcs in one or more colors. Decorative light bulb 10 is generally ornamental in nature and desirable as a novelty or decorative display more than for its utility as a light fixture.

Decorative light bulb 10 preferably includes outer surface 20 forming a decorative shape. The decorative shape may be geometric, arbitrary, symmetrical, non-symmetrical or any other shape having pleasing and/or desirable aesthetics. Accordingly, decorative shape may comprise a diamond, a globe, a cube, an animal such as a dolphin, a skull, a plant such as a mushroom, a tornado shape, a fanciful sculpture or any other feasible configuration. The preceding list is representative and not exhaustive, as the potential decorative shapes for the present invention are limited only by the imagination of the designer and/or the sophistication of the bulb forming equipment.

Decorative light bulb 10, and particularly outer surface 20 is preferably made of a translucent glass, such as colored glass. Any suitable material known to those skilled in the art may be used to produce bulb, being transparent or translucent, of any size, shape, configuration, symmetry and/or color.

As briefly described above, one or more inert gases are preferably inserted within decorative light bulb 10. Possible inert gases include Xenon and Argonne and gases having similar properties known to those having ordinary skill in the art. When a charge is applied to the inert gases, an ethereal electrical arcing is created. Accordingly, when the charge is applied to a decorative light bulb without the additional features described below, the ethereal electrical arcing is generally limited to a first color.

According to a preferred embodiment of this invention, surface feature 30 is formed on outer surface 20. Surface feature 30 is preferably molded or integrally formed with outer surface 20 and generally includes a corresponding inner surface 40 within decorative light bulb 10. Examples of such surface features 30 may include continents on a globe decorative shape; eyes, nose and mouth on a skull decorative shape; contoured edges on a cube decorative shape; and other surface features 30 that distinguish and define the decorative shape.

According to a preferred embodiment of this invention, coating 45 is applied along inner surface 40 of surface feature 30. According to one preferred embodiment of this invention, coating 45 is a phosphor or a similar agent known to those having ordinary skill in the art. More particularly, coating 45 is a tri-band lamp phosphor. Possible tri-band lamp phosphors for use in connection with the subject invention include yttrium oxide, zinc silicate and strontium chlorapatite. According to a preferred embodiment of this invention, coating 45 is not visible from the outside of decorative light bulb 10. As a result, decorative light bulb appears translucent or transparent without any indication of the presence of coating 45.

This localized application of coating 45 along inner surface 40 of surface feature 30 results in, during a powered state of decorative light bulb 10, a second color along inner surface 40 of surface feature 30 thereby distinguishing surface feature 30 from the remainder of outer surface 20. As a result, during operation of decorative light bulb 10, electrical arcing having a first color will illuminate outer surface 20 and electrical arcing having a second color will illuminate surface features 30. This multi-color display results in decorative light bulb 10 having defined areas of color based upon the surface features 30 along outer surface 20 of decorative shape.

According to one preferred embodiment of this invention shown in FIG. 1, decorative light bulb 10 includes a decorative shape comprising a globe and surface features 30 comprising a plurality of contoured continents. As a result of the particular application of coating 30 along inner surface 40 of continents, when decorative light bulb 10 is turned on, outer surface 20 preferably appears blue like the ocean and surface features 30 appear green like land masses.

According to a preferred embodiment of this invention, decorative light bulb 10 includes plug 60. Plug 60 is preferably removably connected with respect to base 70 and more particularly a bore within base 70. Such an arrangement is taught in more detail in U.S. Pat. No. 6,247,829, which is incorporated herein by reference. As a result of the removable arrangement of plug 60 and base 70, two or more distinct decorative light bulbs 10 may be interchangeable within base 70.

In a method of manufacturing decorative light bulb 10 according to this invention, outer surface 20 is formed into a decorative shape using conventional bulb forming techniques. The desired surface feature 30 are additionally formed within outer surface 20. A coating, such as the various phosphors described above, is next applied along inner surface 40 of surface feature 30. Upon completion of outer surface 20 and surface features 30, one or more inert gases are preferably inserted within decorative light bulb 10. Plug 60 may additionally be integrated with decorative light bulb 10 and may be interchangeably removable with respect to base 70.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed:

1. A decorative light bulb comprising:

an outer surface forming a decorative shape;

one or more inert gases within the decorative light bulb creating ethereal electrical arcing having a first color;

a surface feature formed on the outer surface, the surface feature having an inner surface; and a coating applied on the inner surface of the surface feature, the coating resulting in ethereal electrical arcing having a second color along the inner surface of the surface feature.

2. The decorative light bulb of claim 1 further comprising a plug removably connected with respect to a base.

3. The decorative light bulb of claim 2 wherein two or more distinct decorative light bulbs are interchangeable within the base.

4. The decorative light bulb of claim 1 wherein the decorative shape comprises a globe and the surface feature comprises a plurality of contoured continents.

5. The decorative light bulb of claim 1 wherein the coating is a phosphor.

6. The decorative light bulb of claim 1 wherein the decorative shape comprises a cube.

7. The decorative light bulb of claim 1 wherein the decorative shape comprises a skull.

8. The decorative light bulb of claim 1 wherein the decorative shape comprises an animal.

9. The decorative light bulb of claim 1 wherein the coating is not visible from outside of decorative light bulb.

10. A decorative light bulb comprising:

an outer surface forming a globe;

one or more inert gases within the decorative light bulb creating ethereal electrical arcing having a blue color;

a plurality of contoured continents formed on the outer surface, the contoured continents having an inner surface; and a phosphor coating applied on the inner surface of the contoured continents, the phosphor coating resulting in ethereal electrical arcing having a green color along the inner surface of the contoured continents.

11. The decorative light bulb of claim 10 wherein the outer surface and the plurality of contoured continents are formed of a colored, translucent glass bulb.

* * * * *